US007614907B2

(12) United States Patent
Zhang

(10) Patent No.: US 7,614,907 B2
(45) Date of Patent: Nov. 10, 2009

(54) CONTACT TERMINAL WITH SELF-ADJUSTING CONTACT SURFACE

(76) Inventor: Chaojiong Zhang, 762 Peach Creek Cut Off Rd., College Station, TX (US) 77845

( * ) Notice: Subject to any disclaimer, the term of this patent is extended or adjusted under 35 U.S.C. 154(b) by 0 days.

(21) Appl. No.: 12/029,759

(22) Filed: Feb. 12, 2008

(65) Prior Publication Data

US 2009/0203253 A1 Aug. 13, 2009

(51) Int. Cl.
*H01R 3/00* (2006.01)

(52) U.S. Cl. ..... 439/500; 439/930

(58) Field of Classification Search ..... 439/289, 439/500, 930

See application file for complete search history.

(56) References Cited

U.S. PATENT DOCUMENTS

| | | | | |
|---|---|---|---|---|
| 1,247,656 | A | | 11/1917 | Gadke |
| 2,108,504 | A | | 2/1938 | Nowosielski |
| 2,275,762 | A | | 3/1942 | Horton |
| 2,461,980 | A | | 2/1949 | Hansen |
| 2,595,057 | A | | 4/1952 | Cotter |
| 3,725,844 | A | | 4/1973 | McKeown et al. |
| 3,753,214 | A | | 8/1973 | DuRocher et al. |
| 3,860,320 | A | | 1/1975 | Danner |
| 3,992,227 | A | | 11/1976 | Persson |
| 4,091,186 | A | | 5/1978 | Ott et al. |
| 4,206,958 | A | | 6/1980 | Hall et al. |
| 4,221,446 | A | | 9/1980 | Niles et al. |
| 4,242,790 | A | | 1/1981 | Ellingson et al. |
| 4,270,825 | A | | 6/1981 | Marsh |
| 4,365,412 | A | | 12/1982 | Marsh |
| 4,392,703 | A | | 7/1983 | Hall et al. |
| 4,426,128 | A | | 1/1984 | Costello et al. |
| 4,444,445 | A | | 4/1984 | Davies et al. |
| 4,482,615 | A | | 11/1984 | Rosansky et al. |
| 4,483,574 | A | | 11/1984 | Chabrerie et al. |
| 4,494,812 | A | | 1/1985 | Bolton |
| 4,507,858 | A | * | 4/1985 | Fairbairn et al. ..... 29/747 |
| 4,746,300 | A | | 5/1988 | Thevenin |
| 4,909,770 | A | * | 3/1990 | Hesse ..... 446/455 |
| 5,066,555 | A | | 11/1991 | Tamminen |
| 5,103,377 | A | | 4/1992 | Kobayashi et al. |
| 5,141,444 | A | | 8/1992 | Redmond et al. |
| 5,432,025 | A | | 7/1995 | Cox |
| 5,457,609 | A | | 10/1995 | Bhanot et al. |
| 5,467,718 | A | | 11/1995 | Shibata et al. |
| 5,473,242 | A | | 12/1995 | McKenna |
| 5,694,296 | A | | 12/1997 | Urbish et al. |
| 6,008,622 | A | | 12/1999 | Nakawatase |
| 6,188,042 | B1 | | 2/2001 | Sheen |
| 6,233,402 | B1 | | 5/2001 | Soloman et al. |
| 6,319,631 | B1 | | 11/2001 | Bay et al. |
| 6,455,189 | B1 | | 9/2002 | Nadeau et al. |
| 6,635,383 | B2 | | 10/2003 | Maple |
| 6,641,952 | B2 | | 11/2003 | Maple |

(Continued)

*Primary Examiner*—Thanh-Tam T Le
(74) *Attorney, Agent, or Firm*—Law Office of Tim Cook P.C.

(57) ABSTRACT

A self-adjusting contact includes a plurality of conductive fibers, such as wires, arrayed along an axis perpendicular to the major plane of the battery terminal. The contact may include straight or corrugated wires, aligned substantially along the axis. The wires may be arranged in a bundle and held within an electrically conductive holder, which may be cylindrical or bell-shaped, and the wire bundle may be soldered to the bottom of a well formed in the holder.

9 Claims, 4 Drawing Sheets

U.S. PATENT DOCUMENTS 6,794,984 B2 * 9/2004 Komatsu ..... 338/202
7,040,902 B2 5/2006 Li
7,170,006 B1 1/2007 Burrell
7,255,959 B2 8/2007 Chan
7,322,862 B1 1/2008 Burrell
7,423,359 B2 * 9/2008 Lewis et al. ..... 310/248

* cited by examiner

FIG.1 (PRIOR ART)
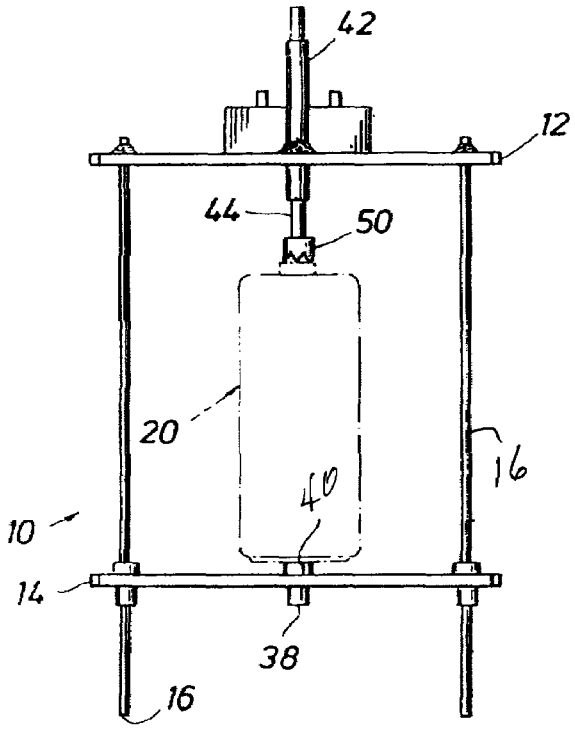
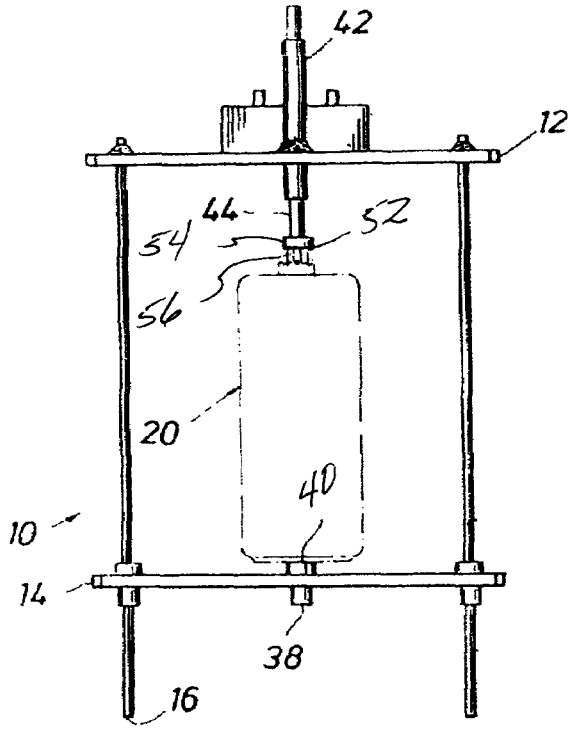
FIG. 2

CONTACT TERMINAL WITH SELF-ADJUSTING CONTACT SURFACE

FIELD OF THE INVENTION

The present invention relates generally to the field of electrical storage devices, and more particularly to a self-adjusting contact surface for contacting a terminal of such an electrical storage device.

BACKGROUND OF THE INVENTION

In the production of small batteries, selected samples of the products are typically tested at various stages in the manufacturing process for quality control. In fact, in certain critical applications, it may be necessary to test every battery made in a manufacturing facility.

Some battery manufacturing plants manufacture batteries in several sizes, such as D cell, AA cell, or other sizes. In any of these cell sizes, the battery is constructed with an elongate cylindrical body with positive and negative terminals at the opposite ends of the body. These types of cells, however, differ in diameter and thickness. The terminal spacing will vary with length. Further, even within manufacturing tolerances, the shape and contour of the terminals may vary enough to present difficulty in making a minimum resistance contact with the terminals.

A battery contact assembly was shown and described in my earlier U.S. Pat. No. 5,903,154. The assembly of the '154 patent enabled a single test assembly to accommodate batteries over a wide range of sizes and shapes. Positive and negative contact terminals were deployed opposite one another and were positioned to clamp against the positive and negative terminals at the ends of the batteries, without regard to the length of the cylindrical battery. For testing, it is necessary to connect to the battery terminals with a high quality, low resistance connection. The quality of the connection is normally assured by controlling the spring force of the spring which forces the battery contact against the terminal. Should the contact force be outside a desired range, false readings may be obtained because the contact is not sufficient to enable full current flow between the battery terminal and the battery contact.

The contact assembly of the '154 patent provided appropriate contact to the battery through the use of a movable contact. That movable contact came into abutting contact with the battery terminal at a plurality of tines or prongs. For most low current applications, the tine contact structure provides adequate contact between the terminal and the contact. For high current applications, however, such as for example 100 amps or higher, such a contact presents a high resistance to current flow between the terminal and the contact, resulting in high temperatures. The high temperatures can damage the battery terminal under test, and can even weld the contact to the terminal. Furthermore, the tines or prongs of the contact did not accommodate the variations in the shape or contour of the terminals, and the contact was thus not self-adjusting.

Thus, there remains a need for a simple, robust, effective contact to minimize the electrical resistance at the point of contact between a battery terminal and a contact. The contact should provide an easy to use contact for a testing assembly, but should also be adaptable to other applications. The contact disclosed herein solves these and other needs in the art.

SUMMARY OF THE INVENTION

The present invention addresses these needs by providing a self-adjusting contact including a plurality of conductive fibers, such as wires, arrayed along an axis perpendicular to the major plane of the battery terminal. The contact may include straight or corrugated wires, aligned substantially along the axis. In a first preferred embodiment, the wires are arranged in a bundle held within an axially oriented electrically conductive holder. The holder may be cylindrical or bell-shaped, and the wire bundle may be soldered to the bottom of a well formed in the holder. The self-adjusting contact makes contact with a planar terminal surface, which may be flat or contoured. Further, the fibers are flexible, which is a relative term. For higher current applications, the fibers should be relatively more rigid, while still retaining flexibility to conform to the terminal surface. Conversely, for lower current applications, the fibers should be less rigid and less force is required to flex the fibers and conform the contact to the terminal surface.

In a second preferred embodiment, the self-adjusting contact may be formed from an insulated cable which is severed to expose a plurality of conductive fibers. A ring of insulation is removed and a quantity of solder is applied to form a solid contact region for electrical and mechanical contact to the cable.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 1 is a side elevation view of a prior art contact assembly of the '154 patent.

FIG. 2 is a side elevation view of a contact assembly with a self-adjusting contact as disclosed herein.

FIG. 5A is an elevation view of a battery positioned between two retracted self-adjusting contacts, while FIG. 5B is an elevation view of the battery of FIG. 5A with the self-adjusting contacts deployed in contact with the battery.

FIG. 5C is an elevation view of a battery positioned between a self-adjusting contact adjacent the positive terminal of a battery and a conventional contact adjacent the negative terminal of the battery.

DETAILED DESCRIPTION OF A PREFERRED EMBODIMENT

Figure 3A:
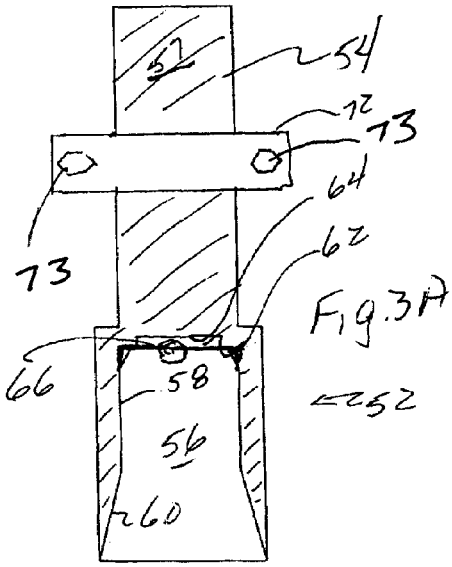
FIG. 3A is a section view of a bundle holder for a self-adjusting contact.

As shown in FIG. 1, a known battery tester 10 includes a pair of parallel printed circuit boards 12 and 14 spaced from one another by a set of connector rods 16. The spacing of the PCBs 12 and 14 accommodates a battery 20 undergoing tests. The thickness of the battery 20 can vary widely. As length is increased, changes in length are accommodated by moving the PCB 14 away or toward the top PCB 12. The length of travel is limited only by the length of the rods 16. A battery negative terminal contacts a contact 38 as the bottom of the battery. Additional details of this prior art structure may be had by reference to U.S. Pat. No. 5,903,154.

Continuing with FIG. 1, a mounting sleeve 42 supports a movable contact rod 44 which is forced downwardly by a spring (not shown). The rod 44 supports a top battery contact 50. The contact 50 has a relatively large contact area and is typically serrated so that it bears with several points on the terminal of the positive battery 20. The force on the spring moves it downwardly against the battery for testing. While this arrangement has been successful, the contact 50 presents too high a contact resistance for higher current applications. The contact disclosed herein improves on that performance.

FIG. 2 illustrates one application of a self-adjusting battery contact 52 of this disclosure. The battery contact of FIG. 2 comprises an axially oriented, electrically conductive holder 54 and a plurality of electrically conductive fibers 56, shown and described below in greater detail. The contact 52 is shown as applied to a test apparatus as previously described, although the contact 54 may be used in many other applications where a self-adjusting contact may find application.

Figure 3B:
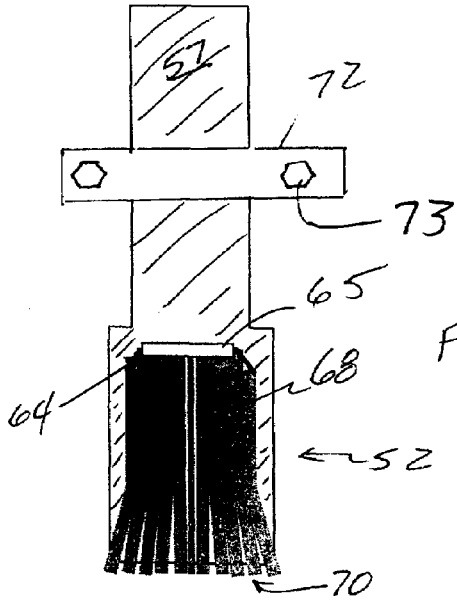
FIG. 3B is a section view of the bundle holder of FIG. 3A with a plurality of electrically conductive fibers installed.

FIGS. 3A and 3B depict a first preferred embodiment of such a self-adjusting contact 52. The contact 52 comprises a holder 54 made of an electrically conductive material, such as for example copper, with a fiber-receiving well 56 formed in the holder and a mounting post 57 extending from the well. In the embodiment of FIGS. 3A and 3B, the fiber-receiving well includes a cylindrical wall 58 and a frustoconical wall 60. The bottom 62 of the well 56 may include a recess 64 which communicates with an orifice 66 which extends through the cylindrical wall 58, shown in FIG. 3A from the front. With the wire bundle in place, a quantity of solder 65 may be introduced through the orifice to solder the fibers to the holder. Alternatively, solder may be located within the recess before the wire bundle is introduced to the holder, and then the entire holder may be heated to the point that the solder melts, thereby providing a robust electrical and mechanical unit of holder and wire bundle.

FIG. 3B shows the embodiment of the holder of FIG. 3A with a bundle of electrically conductive fibers or wires 68 installed in the well 56. As previously described, once the wires 68 are installed in the well 56, solder may be introduced through the orifice 66 to the recess 64 to provide greater electrical conduction between the wires 68 and the holder 54. The cylindrical wall 58 tightly grasps the bundle of wires to hold the wires in the holder, while the frustoconical wall 60 permits space between individual fibers. Some spacing between the wires is called for to permit individual fibers to flex when contacted by the terminal of a battery. In this way, a self-adjusting contact surface 70 of the wires is defined. Very little space, defined as less than the cross-sectional area of the bundle, is needed to allow this flexure of the wires. In other words, while fibers may contact each other within the bundle, the fibers are defined as spaced apart in that throughout the bundle as a whole, some space is built into the bundle to permit the fibers to flex as needed for a self-adjusting contact.

For purposes of illustration, a connecting bracket 72 with bolts 73 is depicted to show that the holder is to be coupled to a power circuit.

Figure 3C:
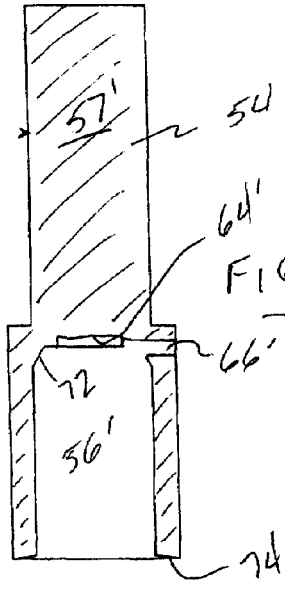
FIG. 3C is a section view of another preferred embodiment for a self-adjusting contact.
Figure 3D:
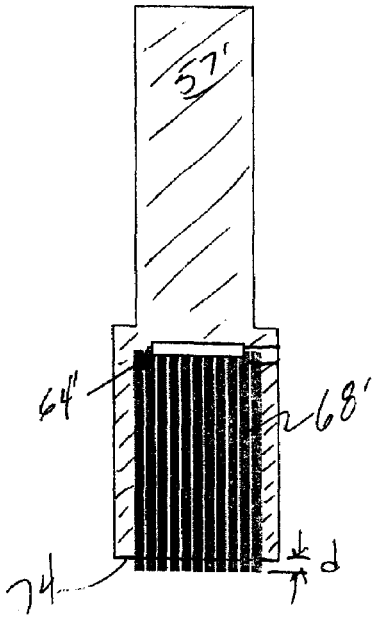
FIG. 3D is a section view of the bundle holder of FIG. 3C with a plurality of electrically conductive fibers installed.

FIGS. 3C and 3D depict a holder 54' comprising a substantially cylindrical well 56' and a mounting post 57' extending from the well. An angled fillet 72 may be provided at the bottom of the well. A recess 64 may also be provided to receive a quantity of solder introduced through an orifice 66', shown in FIG. 3C from the side.

FIG. 3D shows a bundle 68' of electrically conductive fibers installed in the well 56'. In this preferred embodiment, the fibers within the bundle exit the well in a straight line orientation, with adequate spacing between the wires to permit flexure of the wires when a battery terminal is brought into contact with the ends of the fibers. It is to be understood that the term "spacing" refers to the overall bundle of wires, with many of the wires coming into abutting contact with adjacent wires or fibers, but enough overall spacing in the bundle to permit flexure of the fibers. It is also to be understood that the fibers are shown as extending beyond a lip 74 of the well by a distance "d", which is preferably about 1 to 2 mm. In another preferred embodiment, the ends of the fibers are flush with the lip 74. In another preferred embodiment, the ends of the fibers are below the lip 74, as shown and described below in respect of FIG. 7.

Figures 4A, 4B, 4C:
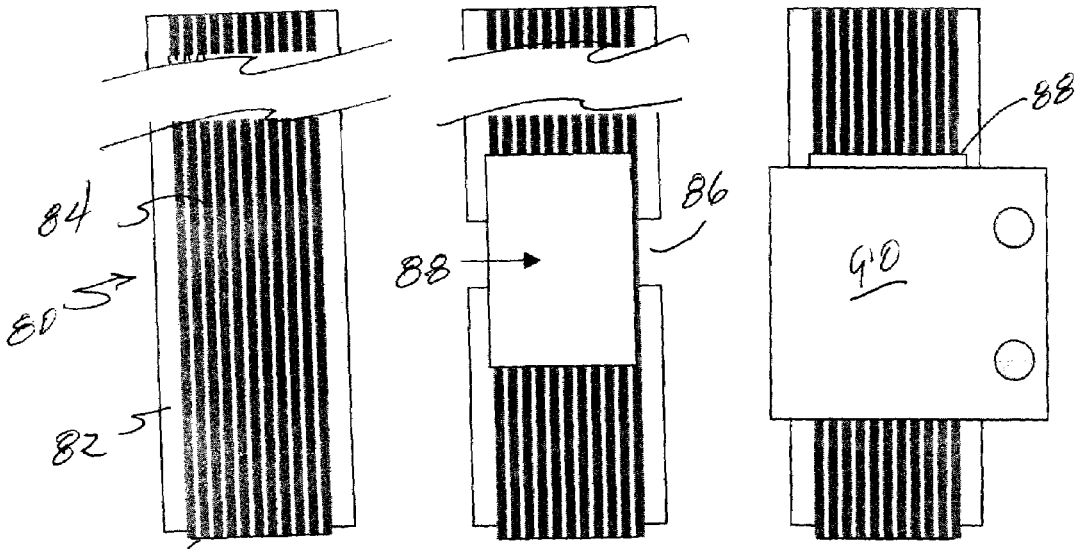
FIG. 4A is a side view of a length of cable which may be used as the starter material for the production of a self-adjusting contact.
FIG. 4B is a side view of an intermediate stage in the production of such a contact from FIG. 4A.
FIG. 4C is a side view of a finished self-adjusting contact from FIGS. 4A and 4B.

To this point, an electrically conductive holder has been described to retain a bundle of wires, which is inserted into the holder. FIGS. 4A, 4B, and 4C illustrate another preferred embodiment of a contact disclosed herein, as well as a method of manufacturing a self-adjusting contact. In FIG. 4A, an insulated cable 80 of indeterminate length includes an outer layer 82 of insulation and a large number of conductive wires in the bundle 84 within the layer 82. The end of the bundle 84 is exposed to define a self-adjusting contact 81 as previously described. A ring of insulation is then removed to expose an annular opening 86. A quantity of solder is introduced into the bundle 84 through the opening 86, to produce a solid block 88. A mounting element 90 is then secured to the solid block 88, allowing secure mechanical and/or electrical connection to the self-adjusting contact. Alternatively, the steps of exposing an annular opening and introducing a quantity of solder may be eliminated, so long as a firm grasp can be made with the mounting element 90. Coupling means 91 are provided to mechanically mount the self-adjusting contact to a bracket (not shown) or other support structure.

By now those of skill in the art will recognize that the embodiments illustrated in FIGS. 3A through 3D, inclusive, will be preferred in applications calling for a discreet contact element that is then mounted into a device such as that shown in FIG. 2. In that application, an electrical connection such as a cable would then be coupled to the device. On the other hand, for the embodiment illustrated in FIGS. 4A through 4C, inclusive, since the self-adjusting contact is formed at the end of a cable, no additional coupling to a cable is needed. The cable itself becomes an integral portion of the contact structure.

Figures 5A, 5B, 5C:
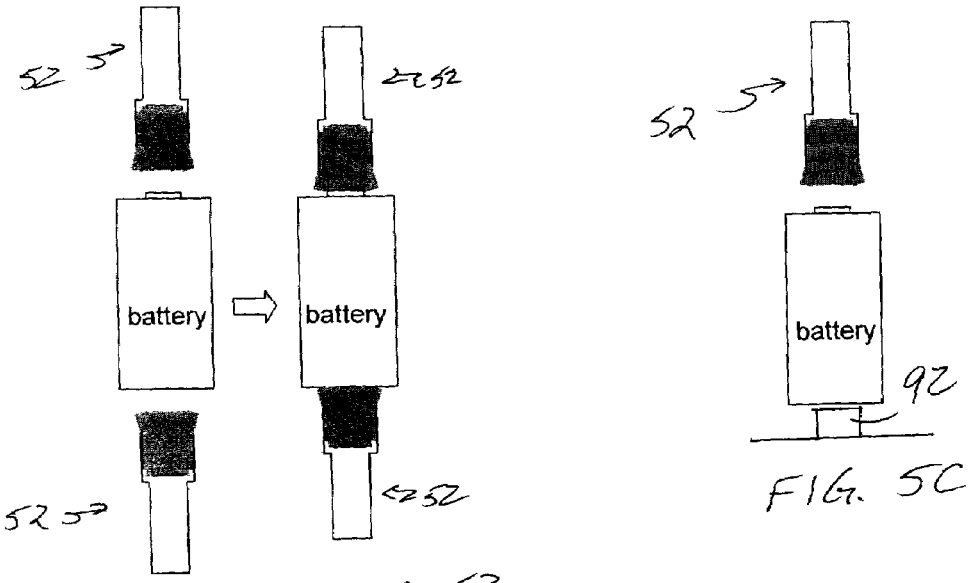

Referring now to FIGS. 5A, 5B, and 5C, a battery 20 is positioned for contact with one or more self-adjusting contacts 52. In FIG. 5A, a pair of contacts 52 are retracted, while in FIG. 5B, the pair of contacts are deployed to come into contact with both the positive and negative terminals of the battery. In this way, self-adjusting contacts make solid contact at both ends of the battery. In other applications, if may be preferred that only one contact 52, for contact with the positive terminal of the battery be used, such as that shown in FIG. 5C. In this instance, an immovable contact 92 is mounted to receive the negative terminal of the battery.

Figure 6:
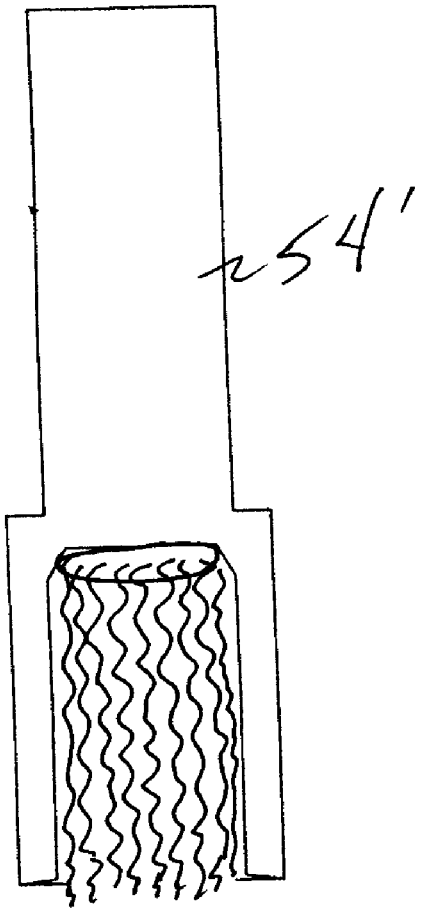
FIG. 6 is an elevation view of a self-adjusting contact in which the individual fibers or wires are corrugated.
Figure 7:
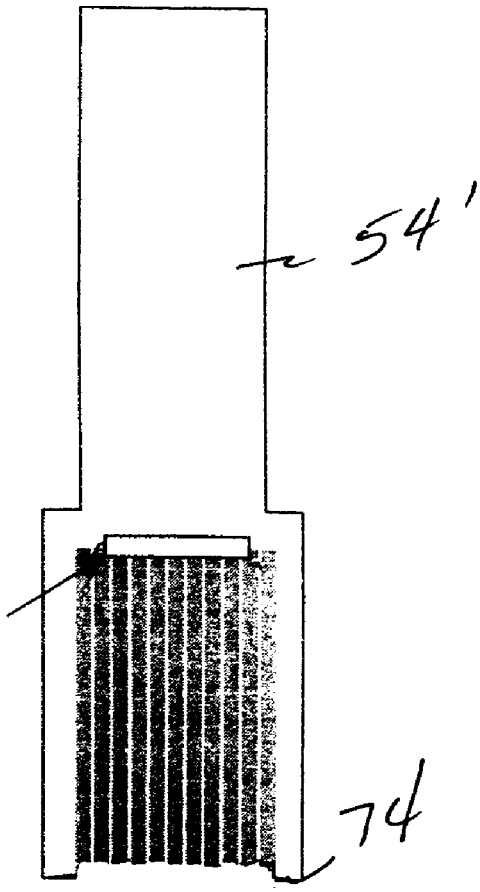
FIG. 7 is an elevation view of a self-adjusting contact in which the fibers are recessed within a well.

Finally, FIG. 6 depicts a self-adjusting contact in which the fibers are corrugated. This embodiment provides greater flexure of the fibers, at the expense of contact force, which may be desired for some applications. FIG. 7, in contrast, illustrates that the fibers may be recessed within the well, below the lip. In this embodiment, less flexure is permitted of the fibers, but greater force is called for for the same amount of conformation of the fiber bundle to the terminal of a battery. This embodiment provides the additional and perhaps even more important feature of aligning the positive terminal of a battery into the recess formed by the lip of the holder with the top surface of the fibers below the lip.

The principles, preferred embodiment, and mode of operation of the present invention have been described in the foregoing specification. This invention is not to be construed as limited to the particular forms disclosed, since these are regarded as illustrative rather than restrictive. For example, while the preferred embodiments are described as being applied to battery terminals, the self-adjusting contact disclosed in the specification may be applied to other contacts which call for the self-adjusting feature. Moreover, variations and changes may be made by those skilled in the art without departing from the spirit of the invention.

I claim:

1. A self adjusting contact for contact with a hard, irregular planar terminal surface defining a terminal area, the contact comprising:

a. an axially oriented, electrically conductive holder having a well and a mounting post extending from the well, the axis of the holder perpendicular to the plane of the terminal surface; and b. a bundle of spaced, flexible wires secured within the well having ends opposite the holder, the bundle of wires directed perpendicular to the irregular planar terminal surface and further defining a contact surface at the ends of the wires adapted for perpendicular stationary conforming contact with the planar terminal surface by bending in random directions from the axis of the holder.

2. The contact of claim 1, wherein the holder defines a lip and wherein the bundle of wires extends beyond the lip of the holder.

3. The contact of claim 1, wherein the holder defines a lip and a holder area at the lip larger than the terminal area and wherein the bundle of wires does not extend beyond the lip of the holder.

4. The contact of claim 1, wherein the well is cylindrical.

5. The contact of claim 1, wherein the well comprises a cylindrical wall adjacent the mounting post and a frustoconical wall adjacent the cylindrical wall.

6. The contact of claim 1, wherein the well defines a bottom and further comprising a recess in the bottom of the well adapted to retain a quantity of solder to secure the bundle of wires.

7. The contact of claim 6, further comprising an orifice extending through the well to communicate solder through the orifice into the recess.

8. The contact of claim 1, wherein the wires are corrugated.

9. A self-adjusting contact for contact with a hard, planar terminal surface, the contact comprising:

a. an axially oriented, electrically conductive holder having a well and a mounting post extending from the well, wherein the well defines a bottom and further comprising a recess in the bottom of the well adapted to retain a quantity of solder to secure the bundle of wires;

b. a bundle of spaced, flexible wires secured within the well; and c. an orifice extending through the well to communicate solder through the orifice into the recess.

* * * * *